US011814909B2

(12) United States Patent
Panayirci et al.

(10) Patent No.: US 11,814,909 B2
(45) **Date of Patent: *Nov. 14, 2023**

(54) ANTI-WHIRL STABILIZATION TOOLS

(71) Applicant: Schlumberger Technology Corporation, Sugar Land, TX (US)

(72) Inventors: Huseyin Murat Panayirci, Cambridge (GB); Jonathan Robert Hird, Cambridge (GB); Joachim Sihler, Cambridge (GB); Ashley Bernard Johnson, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/058,902

(22) Filed: Nov. 28, 2022

(65) Prior Publication Data

US 2023/0092039 A1 Mar. 23, 2023

Related U.S. Application Data

(62) Division of application No. 17/075,740, filed on Oct. 21, 2020, now Pat. No. 11,512,540.

(60) Provisional application No. 62/928,491, filed on Oct. 31, 2019.

(51) Int. Cl.

| | |
|---|---|
| ***E21B 17/10*** | (2006.01) |
| ***E21B 17/02*** | (2006.01) |
| ***E21B 17/046*** | (2006.01) |

(52) U.S. Cl.

CPC ..... *E21B 17/1078* (2013.01); *E21B 17/028* (2013.01); *E21B 17/046* (2013.01)

(58) Field of Classification Search

CPC .. E21B 17/028; E21B 17/046; E21B 17/1078; E21B 44/00; E21B 44/005

See application file for complete search history.

(56) References Cited

U.S. PATENT DOCUMENTS

| | | | |
|---|---|---|---|
| 3,397,017 A | 8/1968 | Grant et al. | |
| 4,905,776 A | 3/1990 | Beynet et al. | |
| 4,982,802 A | 1/1991 | Warren et al. | |
| 4,989,679 A * | 2/1991 | Amaudric du Chaffaut | E21B 17/02 175/325.3 |
| 5,402,856 A | 4/1995 | Warren et al. | |

(Continued)

FOREIGN PATENT DOCUMENTS

WO 2013089810 A1 6/2013

*Primary Examiner* — David Carroll

(74) *Attorney, Agent, or Firm* — Jeffrey D. Frantz

(57) ABSTRACT

A stabilizer can include an outer collar, an inner sleeve, and a locking mechanism. The locking mechanism is changeable between a first mode in which the outer collar is rotationally fixed to the inner sleeve and a second mode in which the outer collar is rotationally isolated relative to the inner sleeve. The stabilizer may include an active or passive system for changing modes. An example passive device may include a magnetic clutch where the detected force overcomes magnetic forces to change mode. The stabilizer can be used to mitigate whirl on a rotating device by switching the rotating device between a rotating mode and a non-rotating mode. In the rotating mode, outer collar may rotate with the inner sleeve. In the non-rotating mode, the outer collar may be rotationally isolated from the inner sleeve.

21 Claims, 7 Drawing Sheets

(56) References Cited

U.S. PATENT DOCUMENTS 5,560,439 A 10/1996 Delwiche et al.
5,738,178 A * 4/1998 Williams ..... E21B 4/02 175/73
5,810,100 A 9/1998 Samford
5,864,058 A 1/1999 Chen
6,179,066 B1 1/2001 Nasr et al.
6,205,851 B1 3/2001 Jogi
6,702,042 B2 3/2004 Genevois et al.
6,935,442 B2 * 8/2005 Boulet ..... E21B 17/1064 175/323
7,185,715 B2 3/2007 Krueger et al.
7,963,347 B2 6/2011 Pabon
8,511,377 B2 8/2013 Casassa et al.
8,550,183 B2 10/2013 Forster et al.
8,890,341 B2 11/2014 Ocalan et al.
2005/0071120 A1 * 3/2005 Hutchinson ..... E21B 44/00 702/150
2007/0289778 A1 * 12/2007 Watkins ..... E21B 28/00 175/40
2010/0101867 A1 4/2010 Sindt et al.
2010/0175888 A1 * 7/2010 Buytaert ..... E21B 41/00 166/381
2011/0114338 A1 5/2011 Casassa et al.
2013/0092439 A1 4/2013 Mauldin et al.
2013/0248247 A1 * 9/2013 Sugiura ..... E21B 47/12 702/9
2014/0158432 A1 6/2014 Simpson
2015/0101865 A1 * 4/2015 Mauldin ..... E21B 44/00 175/40
2015/0354280 A1 * 12/2015 Downton ..... F03B 13/02 175/107
2016/0024848 A1 * 1/2016 Desmette ..... E21B 17/1078 175/74
2021/0131997 A1 5/2021 Hashiguchi

* cited by examiner

ANTI-WHIRL STABILIZATION TOOLS

CROSS-REFERENCE TO RELATED APPLICATIONS

This application is a divisional of U.S. patent application Ser. No. 17/075,740 filed Oct. 21, 2020 and titled "Methods for Mitigating Whirl", which claims the benefit of, and priority to, U.S. Patent Application No. 62/928,491 filed Oct. 31, 2019 and titled "Anti-Whirl Stabilization Tools and Methods". Each of the foregoing is incorporated herein by this reference in its entirety.

BACKGROUND

When drilling a wellbore in an earthen formation, a drill bit may be rotated, such as by rotating the drill string from the surface, or by a downhole mud motor to convert hydraulic energy to rotational energy. As wellbores become longer or deviate from vertical, there can be increases in friction on the drill string. One result of such friction can include the phenomenon of backward whirl. Backward whirl may occur when an imbalanced rotation or lateral movement of the rotating bottomhole assembly causes impact, even briefly, with the borehole wall or other element within a wellbore.

When the spinning bottomhole assembly contacts the borehole wall, the point of contact on the bottomhole assembly may be urged to rotate in a direction opposite the rotational direction of the bottomhole assembly. As drilling speed increases, backward whirl speed can also increase, particularly if the difference between the borehole diameter and the bottomhole assembly decreases.

When whirl occurs, energy put into the system (e.g., torque from the surface or hydraulic energy through the downhole motor) may be lost through inefficient energy usage, and the overall rotation of the bottomhole assembly may be reduced. Additionally, the bottomhole assembly may be damaged, which could result in a costly fishing operation to remove the assembly, or the assembly may be pulled out of hole before a desired depth is reached, which could result in an additional, costly drilling trip. Backward whirl could potentially also lead to reduced wellbore quality in the form of an elliptical shape, tortuosity, or induced fractures.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. Other aspects and features of the claimed subject matter will be apparent from the further description herein, including the drawings and appended claims.

In some aspects, a method of mitigating whirl on a rotating device includes detecting a force on an outer surface of the rotating device, and switching the rotating device between a rotating mode and non-rotating mode. The detection may occur passively or actively. In a passive system, the detected force can cause the change between modes. In an active system, instrumentation may detect the force and a controller may cause the tool to change modes.

An example rotating device includes a stabilizer used for a rotating shaft such as a drill string. The stabilizer may include an outer collar and an inner sleeve at least partially within the outer collar. A locking mechanism may be used and may change between a first mode in which the outer collar is rotationally fixed to the inner sleeve and a second mode in which the outer collar is rotationally isolated relative to the inner sleeve.

An example locking mechanism for use in a device that changes between rotating and non-rotating modes can include a magnetic clutch. One or more magnets on an outer collar may radially and axially align with one or more magnets on an inner sleeve. There may be a magnetic attraction force between the magnets, such that rotation of the inner sleeve causes a generally corresponding rotation of the outer collar. When a force (e.g., friction, torque, etc.) on the outer collar exceeds the magnetic attraction force(s), the outer collar may slip relative to the inner sleeve. As a result, the magnets may become out of radial or axial alignment and the rotation of the outer collar may be isolated such that any rotation it has does not correspond to that of the inner sleeve.

BRIEF DESCRIPTION OF DRAWINGS

In order to describe the manner in which the above-recited and other features of the disclosure can be obtained, a more particular description will be rendered by reference to specific embodiments thereof which are illustrated in the appended drawings. While some of the drawings may be schematic or exaggerated representations of concepts, other drawings may be considered as drawn to scale for some illustrative embodiments, but not to scale for other embodiments. Understanding that the drawings depict some example embodiments, the embodiments will be described and explained with additional specificity and detail through the use of the accompanying drawings in which.

DETAILED DESCRIPTION

Embodiments of the present disclosure relate to generally to drilling. More specifically, some embodiments of the present disclosure relate to drilling wellbores in an earthen formation. More particularly still, some embodiments of the present disclosure relate to tools and methods that reduce whirl while a rotating element drills a wellbore. For instance, an example tool may include a collar that is selectively rotationally coupled to the drill string based on an amount of torque or friction on the collar.

Figure 1:
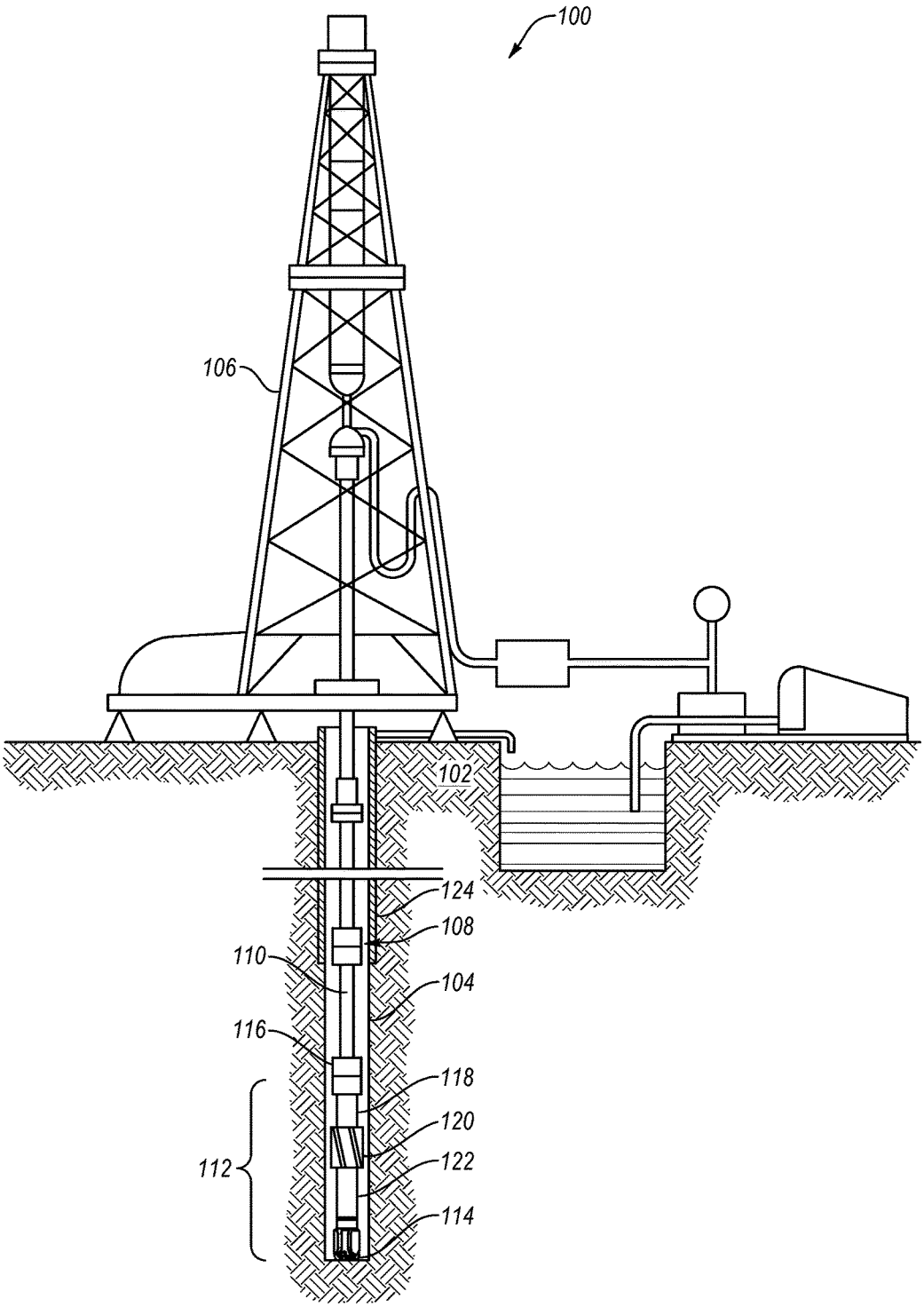
FIG. 1 is a schematic view of a drilling system, according to some embodiments of the present disclosure.

FIG. 1 shows one example of a drilling system 100 for drilling an earth formation 102 to form a wellbore 104. The drilling system 100 includes a drill rig 106 used to turn a drill string 108 which extends downward into the wellbore 104. The drill string 108 may be an assembly including drill pipe 110 and a bottomhole assembly ("BHA") 112. The BHA 112 may include a bit 114 at the downhole end thereof.

The drill pipe 110 may be jointed, such that the drill string 108 is composed of several joints of the drill pipe 110 connected end-to-end through tool joints 116. The drill string 108 can be used to transmit drilling fluid through a central bore. The drill string 108 may itself transmit rotational power from the drill rig 106 to the BHA 112, or may transmit the drilling fluid to a downhole motor (e.g., positive displacement motor, turbodrill motor, etc.) within the BHA 112, which may in turn rotate a drill shaft coupled to the bit 114. The drill pipe 110 provides a hydraulic passage through which drilling fluid is pumped from the surface. The drilling fluid discharges through selected-size nozzles, jets, or other orifices in the bit 114 for the purposes of cooling and lubricating the bit 114 and cutting structures thereon, and for carrying cuttings out of the wellbore 104 as it is being drilled. In some embodiments, the drill string 110 may further include additional components such as subs, pup joints, stabilizers, etc.

The BHA 112 may include the bit 114, other components, or a combination thereof. An example BHA 112 may include one or more drill collars 118, stabilizers 120, or additional or other components 122 (e.g., coupled between to the drill string 108 and the bit 114). Examples of additional BHA components represented at 122 include measurement-while-drilling ("MWD") tools, logging-while-drilling ("LWD") tools, downhole motors, underreamers, section mills, hydraulic disconnects, jars, vibration or dampening tools, steering tools (e.g., rotary steerable tools, bent housings, etc.), other components, or combinations of the foregoing. While FIG. 1 illustrates the additional components 122 below the stabilizer(s) 120, in other embodiments, one or more of the additional components 122 may be located above the stabilizer(s) 120 (e.g., at the position of drill collars 118), or between multiple stabilizers 120.

In general, the drilling system 100 may include other drilling components and accessories, such as special valves (e.g., kelly cocks, blowout preventers, and safety valves). Additional components included in the drilling system 100 may be considered a part of the drill string 108, or a part of the BHA 112 depending on the location in the drilling system 100.

The bit 114 in the BHA 112 may be any type of bit suitable for degrading downhole materials. For instance, the bit 114 may be a drill bit suitable for drilling the earth formation 102. Example types of drill bits used for drilling earth formations are fixed-cutter or drag bits. In other embodiments, the bit 114 may be a mill used for removing metal, composite, elastomer, other materials downhole, or combinations thereof. For instance, the bit 114 may be used with a whipstock to mill into casing 124 lining a full or partial length of the wellbore 104. The bit 114 may also be a junk mill used to mill away tools, plugs, cement, other materials within the wellbore 104, or combinations thereof. Swarf or other cuttings formed by use of a mill may be lifted to surface, or may be allowed to fall downhole.

The embodiment of a BHA 121 shown in FIG. 1 is illustrative. For instance, the additional or other component 122 may represent multiple components, including multiple of one or more other types of components described above, including drill collars or other components therebetween. Additionally, the arrangement may be varied. For instance, the drill collar 118 (or another drill collar 118) may be positioned downhole of the stabilizer 120. Similarly, the additional or other component 122 (or another additional or other component 122) may be positioned uphole of the stabilizer 120, the drill collar 118, or both.

Figure 2:
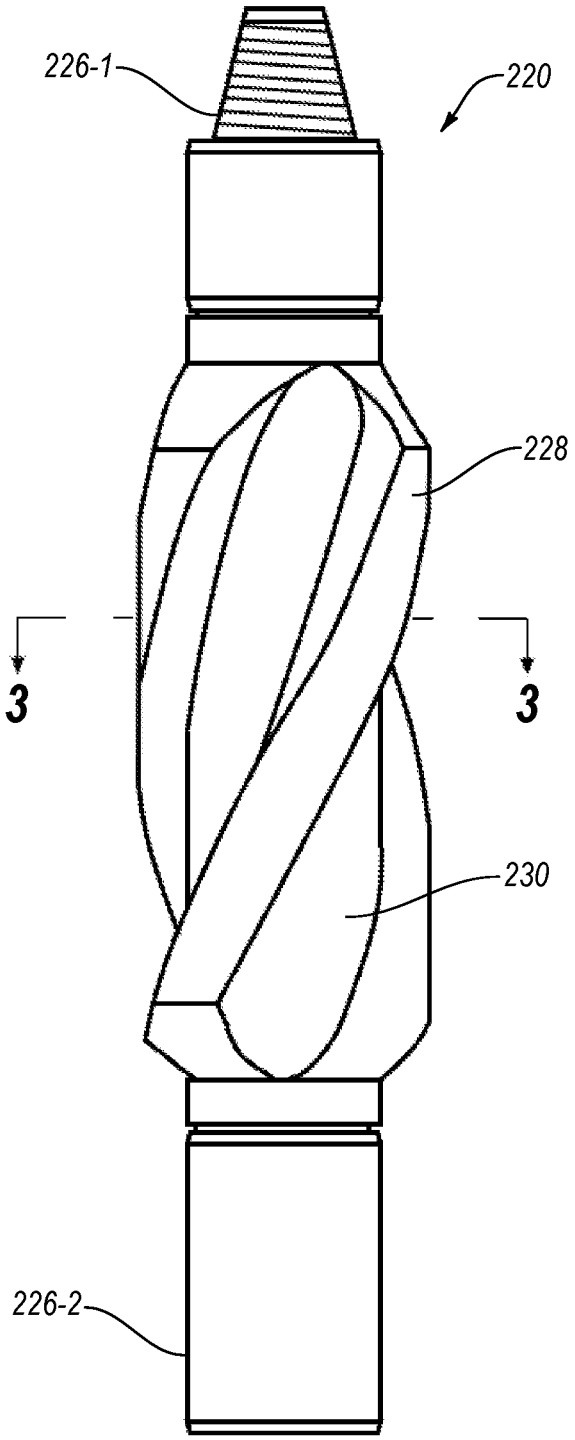
FIG. 2 is a front view of a stabilizer tool, according to some embodiments of the present disclosure.

Turning now to FIG. 2, an example embodiment of a stabilizer 220 (which may be used as stabilizer 120 of FIG. 1), is shown in additional detail. The stabilizer 220 may be positioned in a string of drill pipe (including in a BHA) above the drill bit. The stabilizer 220 can be used to maintain the orientation and position of all or a portion of the BHA (e.g., the drill bit) within the wellbore. For instance, the stabilizer 220 may be connected to the BHA or other portion of the drill string using tool joints 226 (including pin connection 226-1 and box connection 226-2). The rigidity of the stabilizer 220 may then be used to maintain the drill bit about its axis, which is ideally aligned with the axis of the BHA, the drill string, and the wellbore. Such a stabilizer can minimize an amount the drill bit and BHA drift side-to-side within the wellbore, as well as the tilt off vertical (or away from a desired azimuthal angle for a directional wellbore).

The stabilizer 220 may also contact the inside of the wellbore wall in order to maintain the BHA or drill bit in a desired position or orientation. In particular, as noted herein, drilling fluid may flow through the drill string, including through the stabilizer 220. The fluid can exit ports in the drill bit or BHA and circulate up to the surface within an annulus between the drill string and the inner wellbore wall. To allow the fluid to flow upward (and to carry any suspended cuttings or swarf), the stabilizer 220 may include one or more ribs or blades 228 that protrude radially from the body of the stabilizer 220. An area between the ribs 228 is recessed relative to the outer radial surface of the ribs 228, and forms a fluid course 230 providing a sufficient annular volume for the circulating flow of drilling fluid.

The design of the ribs 228 and the fluid courses 230 may be optimized based on any number of considerations. For instance, in addition to centering and positioning a drill bit or BHA, the stabilizer may reduce vibrational forces within the drill string. The design of the centralizer (e.g., length, shape, etc.) may be designed to reduce vibrations. Additionally, as the outer surfaces of the ribs 228 contact the inner wellbore wall, forces will be transferred to the stabilizer 220. This includes friction as the stabilizer 220 slides and potentially rotates while in contact with the wellbore wall, as well as stresses on the shearing blades (e.g., compression and shear forces due to contact with the wellbore wall). The design of the stabilizer may therefore be optimized for the anticipated forces and stresses.

Other considerations may include optimizations for drilling fluid flow and cutting transport, to provide desired steering performance, and to reduce whirling tendency. These factors may also be interdependent. For instance, whirling tendency can affect borehole size and steerability. These optimizations may influence a number of factors, including the length of the stabilizer 220 and ribs 220, the longitudinal shape of the ribs 220 and fluid courses 230 (e.g., straight, angled, helical, etc.) the width and outer profile of the ribs to define contact area, the material used for the stabilizer 220 (including ribs 220), whether gauge protection elements are positioned on the contact surfaces, and the like. Optimization may be performed in various manners. For instance, designs may be created and tested in a downhole or simulated downhole environment. Other optimizations may include simulation software that models tool designs using a physics-based model that includes consideration of the drilling fluid, formation types, expected forces, BHA design, and the like. Computational fluid dynamics (CFD) may additionally or alternatively be used, such as to model cuttings transport through he fluid courses 230.

Still further considerations for the design of the stabilizer 220 may include whether the stabilizer 220 is rotationally fixed to the drill string (and thus rotates with the drill string), or whether the stabilizer 220 is rotationally isolated from the drill string (and is either geostationary or may rotate at a different rate than the drill string). According to some embodiments of the present disclosure, the ribs 228 are rotationally fixed relative to the drill string. In some other embodiments, the ribs 228 are rotationally isolated from the drill string. In still further embodiments, the ribs 228 can selectively change between rotationally isolated and rotationally fixed configurations.

Figure 3:
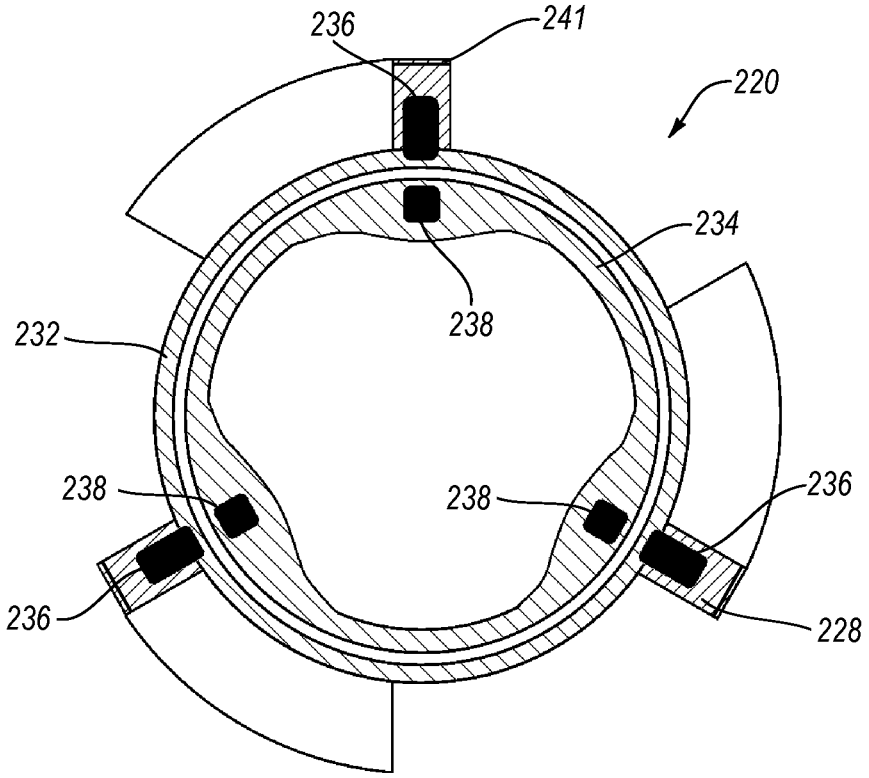
FIG. 3 is a schematic cross-sectional view of a stabilizer tool taken along line 3-3 of FIG. 2.

FIG. 3, for instance, schematically illustrates an example of the stabilizer 220 in a view taken along line 3-3 of FIG. 2. The stabilizer 220 includes radially extending ribs 228 attached to an outer body or collar 232. Inside the collar is an inner body or sleeve 234. According to some embodiments, the inner sleeve 234 is rotationally fixed to the outer collar 232. In other embodiments, the outer collar 232 and inner sleeve 234 are rotationally isolated. In the embodiment shown in FIGS. 3 and 4, the outer collar 232 and inner sleeve 234 are selectively movable between rotationally fixed and rotationally isolated configurations.

Figure 4:
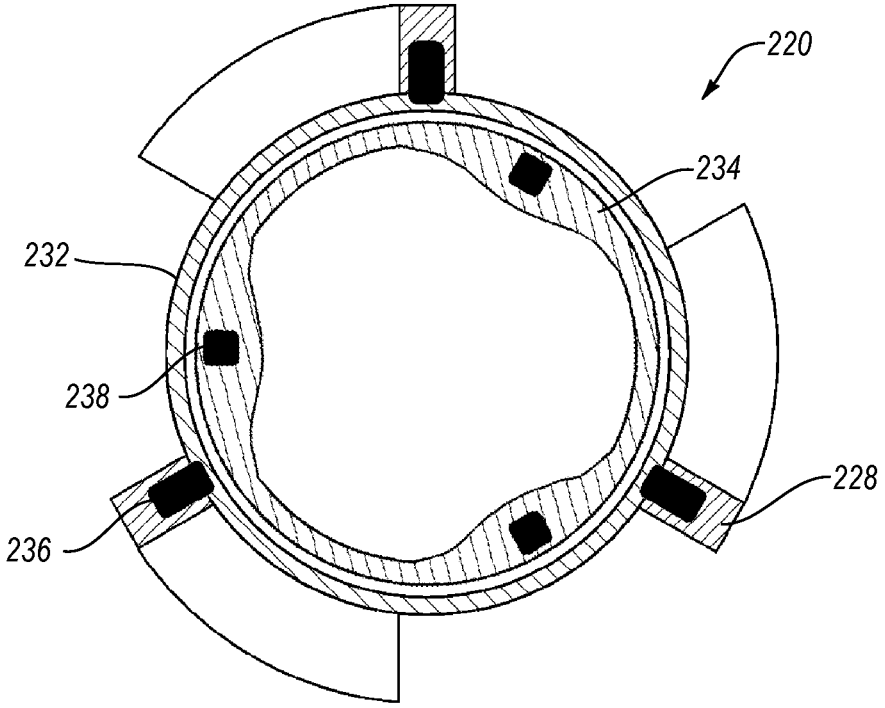
FIG. 4 is a schematic cross-sectional view of the stabilizer tool of FIG. 3, with an outer collar rotated relative to an inner sleeve, according to some embodiments of the present disclosure.

In particular, as shown in FIGS. 3 and 4, the outer collar 232 (optionally including one or more ribs 228) can include an outer coupling element 236. This outer coupling element 236 may include a screw/bolt, weld, clamp, or other tool that couples the outer collar 232 to the inner sleeve 234. In some embodiments, the outer coupling element 236 may be selectively releasable to disengage and thereby allow the outer collar 232 to rotate relative to the inner sleeve 234 (which includes remaining about stationary while the inner sleeve 234 rotates).

In a particular embodiment, the outer coupling element 236 may include a magnet. In some embodiments, the magnet is an electromagnet. In other embodiments, the magnet has other configurations. For instance, the magnet 236 may be a rare-earth type magnet of high magnetic density. Examples of such magnets can include neodymium magnets (e.g., NdFeB) that can be stable up to temperatures of 180° C., samarium cobalt magnets (e.g., FmCo) that can be stable up to temperatures of 400° C., or other types of magnets, including magnets that may be developed in the future.

According to some embodiments, the magnets 236 may be magnetically attracted to the inner sleeve 234. As a result, a magnetic bond may be formed that generally fixes the outer collar 232 to the inner sleeve 234, including by rotationally fixing the outer collar 232 relative to the inner sleeve 234. In some embodiments, this may be facilitated by including corresponding inner coupling elements 238 (e.g., magnets) on or within the inner sleeve 234. For instance, the magnets 236 of the outer collar 232 as shown in FIG. 3 may have a North polarity oriented radially inwardly toward the inner sleeve 234, while the magnets 238 of the inner sleeve 234 may have a South polarity oriented radially outwardly toward the outer collar 232. Thus, there may be an attraction force created between magnets 236, 238 when they are rotationally aligned as shown in FIG. 3. Of course, the opposite arrangement may be used, and with the outer magnet 236 having a South polarity oriented toward the inner sleeve 234 and the inner magnet 238 having a North polarity oriented toward the outer collar 232. In some embodiments, if there are multiple magnets 236 or 238 in the corresponding outer collar 232 or inner sleeve 234, each may have the same polarity (i.e., each of the magnets 236 shown in FIG. 3 may have the same polarity, and each of the magnets 238 shown in FIG. 3 may have the same, but opposite polarity relative to magnets 236). In other embodiments, however, the polarities may alternate or otherwise change. For instance, one or more of the magnets 236 of the outer collar 232 may have a North polarity oriented toward the inner sleeve 234, while one or more other of the magnets 236 may have a South polarity oriented toward the inner sleeve 234. The inner sleeve 234 could have corresponding numbers of opposing polarities of magnets 238.

Although FIG. 3 illustrates three sets of magnets 236, 238 in each of the outer collar 232 and inner sleeve 234, respectively, this is illustrative only. As discussed in more detail herein, the magnetic or other coupling force may be selected to allow a torque or frictional f force exceeding a particular threshold to overcome the attachment force between the magnets 236, 238. Thus, with fewer (or smaller or less powerful) magnets, a lower force may overcome the attachment force, while more (or larger or more powerful) magnets may be decoupled after a larger force is applied. Thus, in other embodiments, a single magnet 236 and/or 238 in one or more of the outer collar 232 or inner sleeve 234 may be used at a particular cross-sectional position (or potentially along a full length of the stabilizer 220). In other embodiments, up to two, three, four, five, ten, twenty, fifty, one hundred, or more magnets 236, 238 may be used in a single cross-section or along a full length of the stabilizer 220.

As can be visualized with reference to FIG. 1, when the stabilizer 220 is within a wellbore and rotates, inner sleeve 234 and outer collar 232 may rotate together. At times, the outer surfaces of the ribs 228 may contact an inner wellbore wall. This contact can result in friction, impact, torque transfer, or other forces between the wellbore wall and the outer collar 232 (i.e., through ribs 228). These forces may cause a loss of torque at the outer collar 232, tending to slow rotation of the outer collar 232 relative to the inner sleeve 234. When this occurs, the frictional force can exceed the magnetic attraction force, thereby breaking the magnetic attraction and causing the inner sleeve 234 to rotate relative to the outer collar 232 as shown in FIG. 4. When this occurs, the rotation of the outer collar 232 is isolated relative to the inner sleeve 234, such that the outer collar 232 acts as a stator and the inner sleeve 234 acts as a rotor. This isolated rotation can occur until the inner sleeve 234 rotates sufficiently to again align magnets 238 with magnets 236, provided there does not continue to be a sufficiently high frictional force to overcome the attractive forces.

Thus, the outer collar 232 (or stabilizer portion of the stabiliser 220) can initially be attached to the drill string (which is attached to inner sleeve 234) such that they rotate in unison with the rotary motion provided by a downhole motor, surface tools, or the like. At high rotary speeds, the ribs 228 of the outer collar 232 may encounter contact with the wellbore and trigger backwards whirl. These frictional forces can cause slipping/decoupling when the torque on the outer collar 232 exceeds that on the inner sleeve 234 (due to the forces that create the backwards whirl), such that the same forces that can lead to whirl can also decouple the rotation of the outer collar 232 with respect to the inner sleeve 234 and the drill string, possibly making the outer collar 232 stationary relative to the earth frame. In this manner, the magnets 236, 238 may act as a type of magnetic clutch.

With a magnetic assembly, some embodiments include tuning the ease of rotation after a slip/decoupling by overlapping magnets in the specific path, thereby gradually changing the attractive force between the inner sleeve 234 and the outer collar 232. This would enable adjusting the response according to the direction or speed of the rotation, which could act as a dampening mechanism. Thus, a magnetic clutch may have more than two states (i.e., free or locked), and can have a variable degree of resistance which can be adjusted according to desired tool specifications. Additionally, as discussed, magnets 236, 238 may include electromagnets. In such an embodiment, the electromagnets may be used by applying an electrical current through them. Thus, controlling when the magnets 236, 238 have and don't have a current may be used to control whether the outer collar 232 is rotationally isolated relative to the inner sleeve 234.

As discussed herein, the actuator that selectively couples the rotation of the outer collar 232 and inner sleeve 234 may be magnetic, but may have other configurations. For instance, a shape memory alloy actuator may be used to control a locking mechanism that selectively decouples the rotation of the outer collar 232 and inner sleeve 235. Embodiments of the present disclosure may, therefore, be used to mitigate whirl. However, the embodiments of the present disclosure are not limited to stabilizers but could be incorporated into casing centralizers, bit or reamer gauge pads, or within other drilling tools. Whirl mitigation tools can also include either active or passive tools. Passive tools, for instance, can include the magnetic tool described herein, and can be considered as self-contained units that uses a magnetic, mechanical, or other mechanism which can trigger when drilling conditions that likely to lead to whirl are triggered. A passive tool can also be one which includes features to dampen shocks. Active tools can be considered as those including instrumentation (e.g., sensors, an on-board micro-processor) and actuators to change geometry of a tool, change frictional characteristics (e.g., rotationally coupled to the drill string vs. rotationally decoupled from the drill string), or to activate/deactivate a damping mechanism. Active tools may include telemetry or other communication features for communicating with the driller at surface to advise on status of the tool and those drilling parameters which may be desirable.

Figure 5:
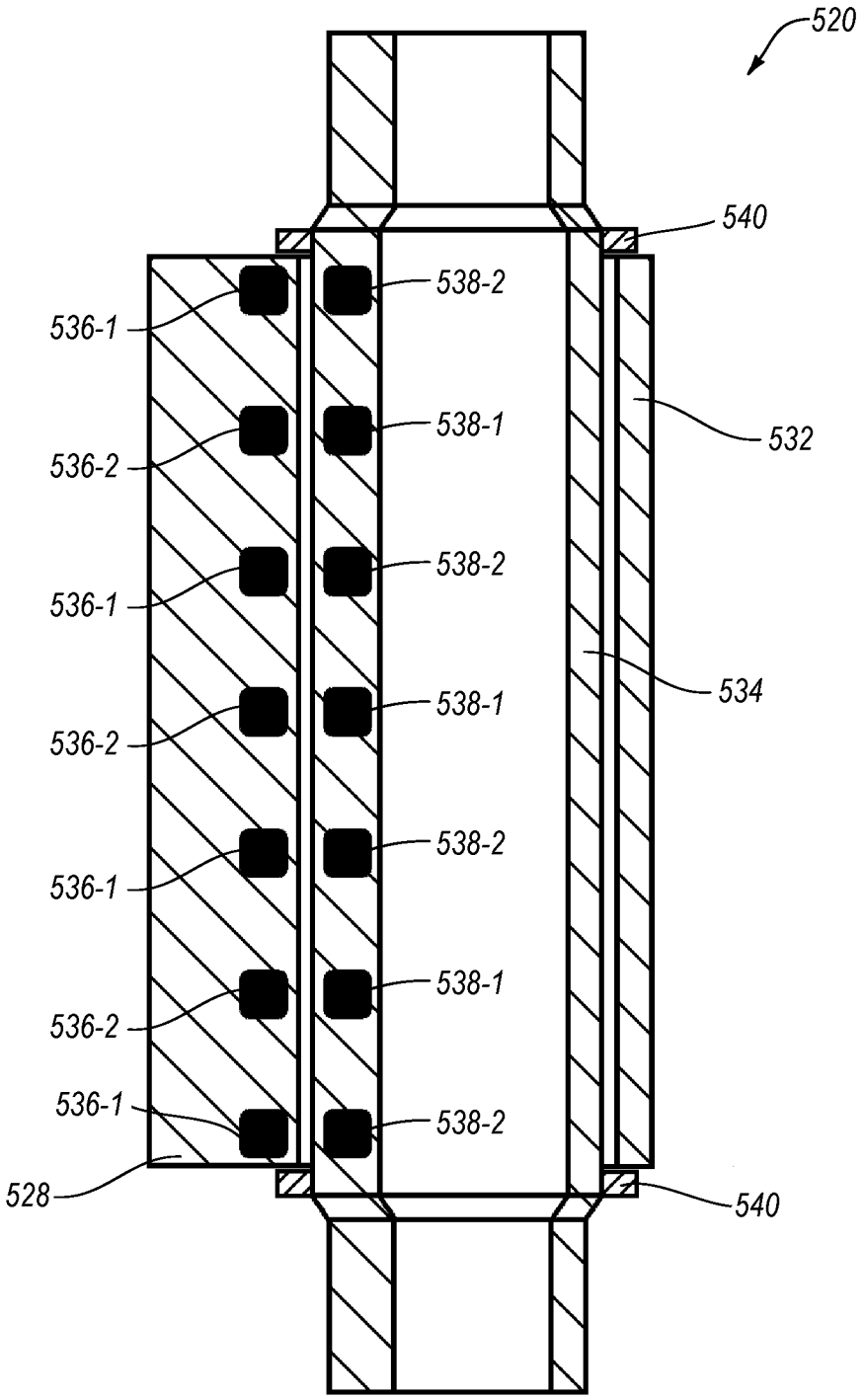
FIG. 5 is a schematic, front cross-sectional view of a stabilizer tool with an outer collar that is selectively, rotationally isolated from an inner sleeve, according to some embodiments of the present disclosure.

FIG. 5 is a cross-sectional view of another example of a stabilizer 520 using a magnetic clutch mechanism to couple/decouple an outer collar 532 relative to an inner sleeve 534. In this embodiment, a rib 528 of the outer collar 532 is shown as having a straight arrangement; however, the rib 528 may be angled, helical, or have other configurations. Thus, this should be understood to represent a schematic view of the rib 528 if a full axial length is shown in a single plane.

As shown, the rib 528 (or outer collar 532) may include multiple magnets 536-1, 536-2 extending along the axial length thereof. Corresponding magnets 538-1, 538-2 may be coupled to the inner sleeve 534. As discussed herein, the magnetic clutch can be tuned by adding more or fewer magnets in order to set a threshold holding force (magnetic attraction force) that couples the inner sleeve 534 to the outer collar 532. This tuning may occur not only in a single radial plane as shown in FIGS. 3 and 4, but may occur along the axial length of the stabilizer 520.

The magnets 536-1, 536-2 are shown in FIG. 5 to have an alternating pattern. This is illustrative only. For instance, the magnets 536-1, 536-2 may be identical. In such case, the magnets 526-1 have the same polarity as magnets 536-2. In other embodiments, the magnets 526-1 have an opposite polarity as compared to magnets 536-2, so an orientation of the North and South polarity may alternate along the length of the outer collar 532. Magnets 538-1, 538-2 could correspondingly vary based on the polarity of the magnets 536-1, 536-2. In other embodiments, the polarity may not alternate, but may still vary. For instance, the upper and bottom most magnets 536-1, 536-2 may have one polarity while intermediate magnets 536-1, 536-2 may have an opposing polarity.

One aspect of magnets 536-1, 536-2 and magnets 538-1, 538-2 that change polarity along the length of the stabilizer 520 is that the magnets may provide a holding force that tends to keep the outer collar 532 aligned axially on the inner sleeve 534. For instance, if magnets 536-1 and 538-1 have a North polarity and magnets 536-2 and 538-2 have a South polarity, the magnetic forces will resist axial movement that would attempt to align North-North and South-South poles. Other mechanisms may, however, also be used to maintain the outer collar 532 at the desired axial position. For instance, locking rings 540 are shown in FIG. 5 as being coupled to the inner sleeve 534. The locking rings 540 may extend radially from the inner sleeve 534 a sufficient distance to restrict the outer collar 532 from significant axial movement, which retains the outer collar 532 on the inner sleeve 534. The locking rings 540 may be attached in any suitable manner, including through use of mechanical fasteners, a friction fit, welding, other mechanisms, or combinations of the foregoing.

As discussed herein, a stabilizer or other tool of the present disclosure may be used in a downhole environment in a manner that mitigates a tendency of the tool to whirl. Drill string whirl is a phenomenon occasionally encountered during drilling activities when operating parameters such as weight on bit, rotary speed, torque and friction form the right conditions to produce a stable nut undesirable dynamic state. This dynamic state can be characterized by not only rotation of the object about its geometric center, but the geometric center of the object also rotates around the wellbore. This motion can be described as chaotic, backwards, or forwards relative to the rotation direction. Both backwards and chaotic whirl are may be considered to be particularly damaging as the translation of the components of the input forces can laterally create high shock and vibrations levels which damage both downhole tools and formation. Particularly in tools with minimal or no instrumentation, the whirling state can go unnoticed by the driller unless the whirl propagates up the drill string and manifests itself at surface. The whirling state may be so stable that the driller may find ceasing rotation is the most effective manner of stopping the behaviour. Limiting and potentially preventing whirl before it develops would therefore be particularly desirable, and could lead to increased efficiency (i.e., higher transfer of power in to the drill bit), greater longevity of tools, boreholes of superior quality, and perhaps allow higher rotary speeds to be used during drilling, which could improve drilling rate of penetration. Some manners of resisting whirl can include decreasing the friction between the wellbore and the drilling tool, by absorbing lateral shocks thereby disrupting the route to whirl, and actively altering the geometry of the tool to break periodicity of impacts which act as the ramp to whirl.

The stabilizers of FIGS. 2 to 5 may be characterized as tools that can be used to resist/mitigate whirl by decreasing friction between the wellbore and the drilling tool. In particular, the outer part (e.g., outer collar 232, 532) can be decoupled from an inner part (e.g., inner sleeve 234, 534) and allowed to rotate freely with respect to the rest of the drill string. As discussed herein, and in electrical motor terminology, the outer part could therefore be described as the stator (which can be made stationary relative to the earth frame of reference) and the inner part as the rotor, which is coupled to the drill string. Introducing rotary decoupling can significantly reduce friction between the drill string and the formation.

In its simplest form, the decoupling mechanism is used to unlatch the stator from the rotor when a physical condition is met. Such conditions could be an increase in friction or when excess shock and vibration levels are detected by a mechanical mechanism or by on-board instrumentation. For example, the stator could be unlocked by a powered actuator controlled via a microprocessor as a response to vibrations and shocks experienced by accelerometers. Alternatively, the rotor and the stator could be coupled through magnetic force such as is shown in FIGS. 2-5. This could either be via passive magnetic force using permanent magnets or via permanent electromagnets (e.g., with an attractive magnetic field when unpowered), but made to uncouple when the electromagnet receives electrical power.

In the same or other embodiments, the outer part of the stabilizer can be rotationally locked to the inner part when tripping in or pulling out of hole but can freely rotate when drilling forwards commences. Additionally, friction may be reduced by creating a friction reducing coating 241 on the areas of the drilling tool which contact the wellbore (e.g., the outer surfaces of ribs 228, 528). This could either be applied before drilling as a coating or jetted as a lubricant downhole. When applied downhole, the coating 241 could be a constant part of the drilling fluid, or controlled through a valve in the drilling tool. The flow could be through all of the ribs, but it could be through less than all ribs, which could reduce symmetry of the tool.

The use of dampeners may also be used to mitigate whirling tendencies, such as by absorbing the impact energy more efficiently when interacting with the wellbore. This could be achieved using elastomeric materials, springs, pneumatic dampers, other dampeners, or combinations of the foregoing, which can act to decrease the coefficient of restitution and thereby decease the likelihood of the tool entering a whirling state.

Figure 6:
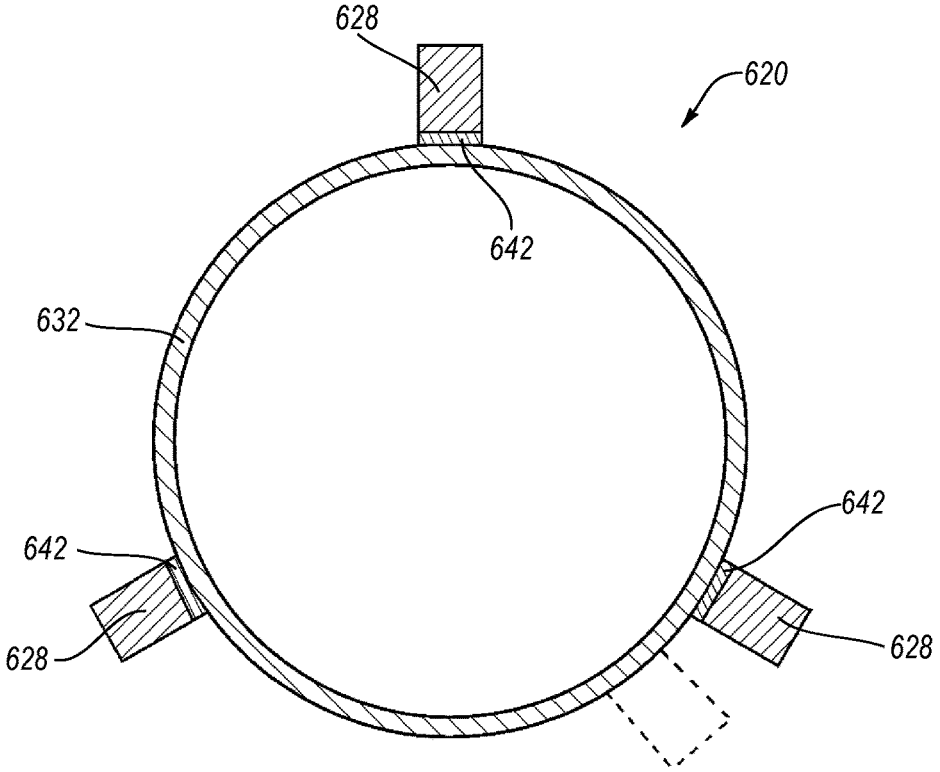
FIG. 6 is a schematic cross-sectional view of a stabilizer tool with ribs coupled to a collar using a compressible material, according to some embodiments of the present disclosure.

For instance, FIG. 6 illustrates a stabilizer 620 that includes a plurality of radially extending ribs 628. In the illustrated embodiment, a compressible material 642 is positioned between the ribs 628 and the body 632 of the stabilizer 620. The compressible material 642 may be any material that is more compressible than the ribs 628. For, instance, the compressible material 642 may be a shape memory alloy, a polymer, an assembly including one or more springs, or other elements. In other embodiments, the separate compressible material 642 may be eliminated and the ribs 628 may be formed of a material that is intended to be elastically compressible in one or more directions.

By disrupting the geometric symmetry of a tool, whirl may also be disrupted. For instance, bit blades or gauge pads may be at different angles or have different lengths in order to disrupt symmetry. Similarly, the ribs of a stabilizer may be varied in position or form to disrupt symmetry. By way of example, one or more of the ribs 628 of FIG. 6 may have a different compressible material 642 or may have no compressible material to disrupt symmetrical performance. In another embodiment, a rib 628 may be at a different angular spacing (see dashed lines) so that there is an unequal spacing between at least two of the ribs 628. Other embodiments include modify the shape of the gauge pad, rib, or blade of the tool with an actuator. The actuator may be part of an open loop or closed loop control system. These changes to the geometry could include altering of one or more pads, ribs, or blades in terms of outer diameter, angle, or adjustments in geometry to the lead and trailing edges.

Figure 7:
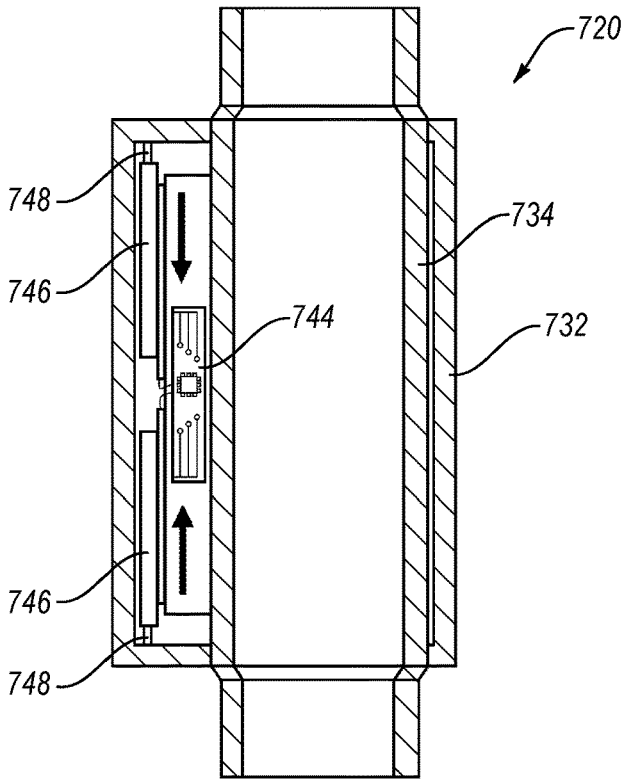
FIG. 7 is a schematic, front-cross-sectional view of a stabilizer tool with an active mechanism for locking rotation of a collar to a sleeve, according to some embodiments of the present disclosure.

Certain tests have been performed by the inventors of the present application to evaluate the various embodiments of the present disclosure in mitigating whirl. One test was performed with a magnetic clutch assembly, using a design generally consistent with that shown in FIGS. 2 to 5. Another was performed using an active device schematically shown in FIG. 7. The stabilizer 720 includes an inner sleeve 724 within an outer collar 732. A controller 744 is included, and has a processor and sensors (e.g., accelerometers) to detect vibration, impact forces, and the like. The controller 740 is coupled to actuators 746, which in the illustrated embodiment are linear actuators. When the stabilizer 720 is in normal use, the actuator 746 uses a locking mechanism 748 (e.g., locking pin) to engage the outer collar 732 and rotationally couple the outer collar 732 to the inner sleeve 732 (and thus the drill pipe). Upon sensing increased vibration, impact, or other forces that could represent whirl, the controller 744 sends a signal to the actuator 746, which move in the directions of the arrows in response, and thereby retract the locking mechanisms 748. Upon detecting reduced vibration or other movement, the controller 744 may send a signal instructing the actuators 746 to move in the directions opposite the illustrated arrows to again lock the rotation of the outer collar 732 to the inner sleeve 734.

In the performed tests, numerical models have been used to provide some estimates on the torque values below which the stabilizer should remain coupled to (and rotate with) the drill string. Similarly, upper threshold values are also calculated (i.e., torque estimations during backward whirl), above which the mechanism in place (clutch, electromagnets, actuators, etc.) should allow the stabilizer to slip with respect to the drill string.

Figure 8:
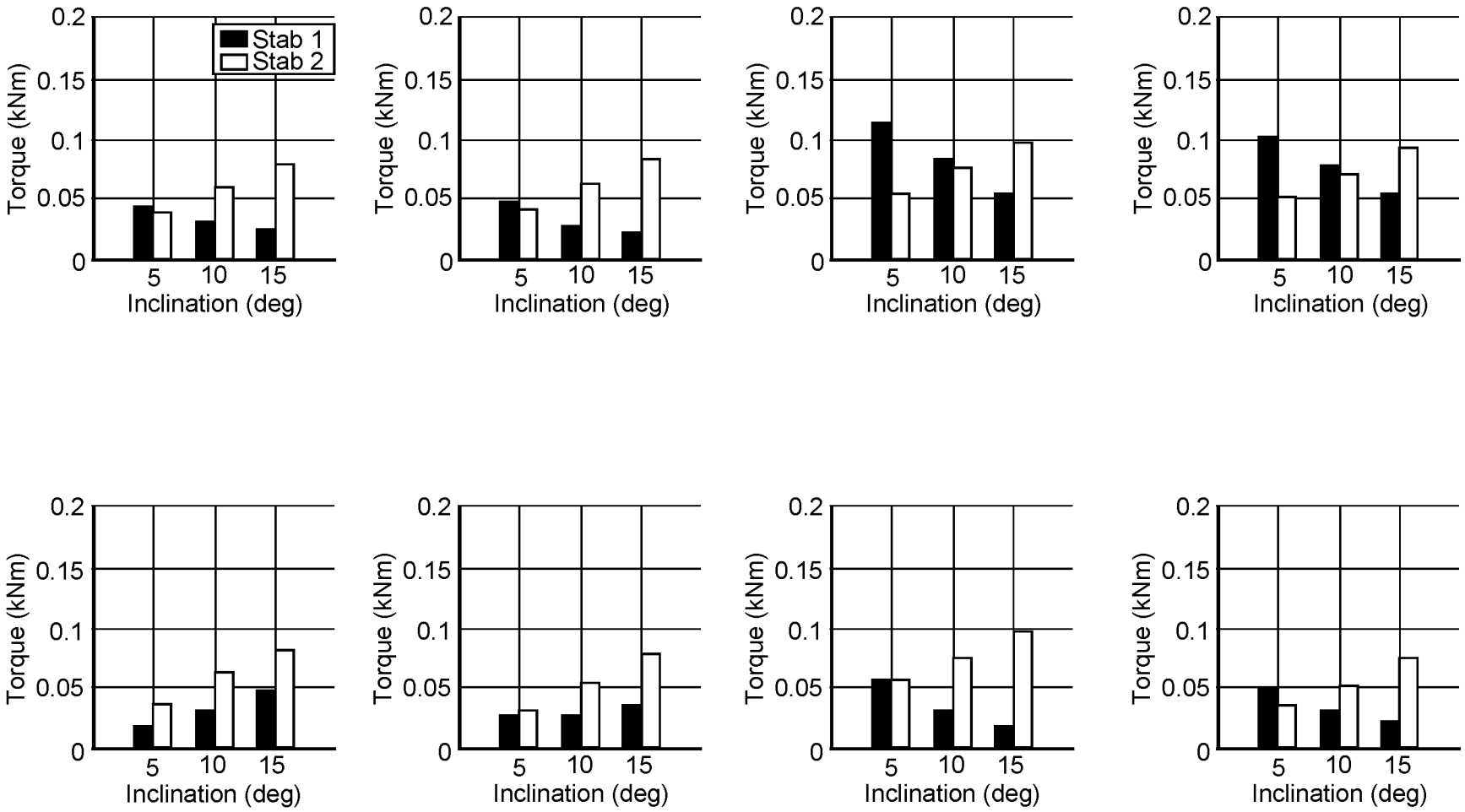
FIG. 8 includes various plots of torque values at stabilizers within different BHAs and for different wellbore inclinations, according to some embodiments of the present disclosure.
Figure 9:
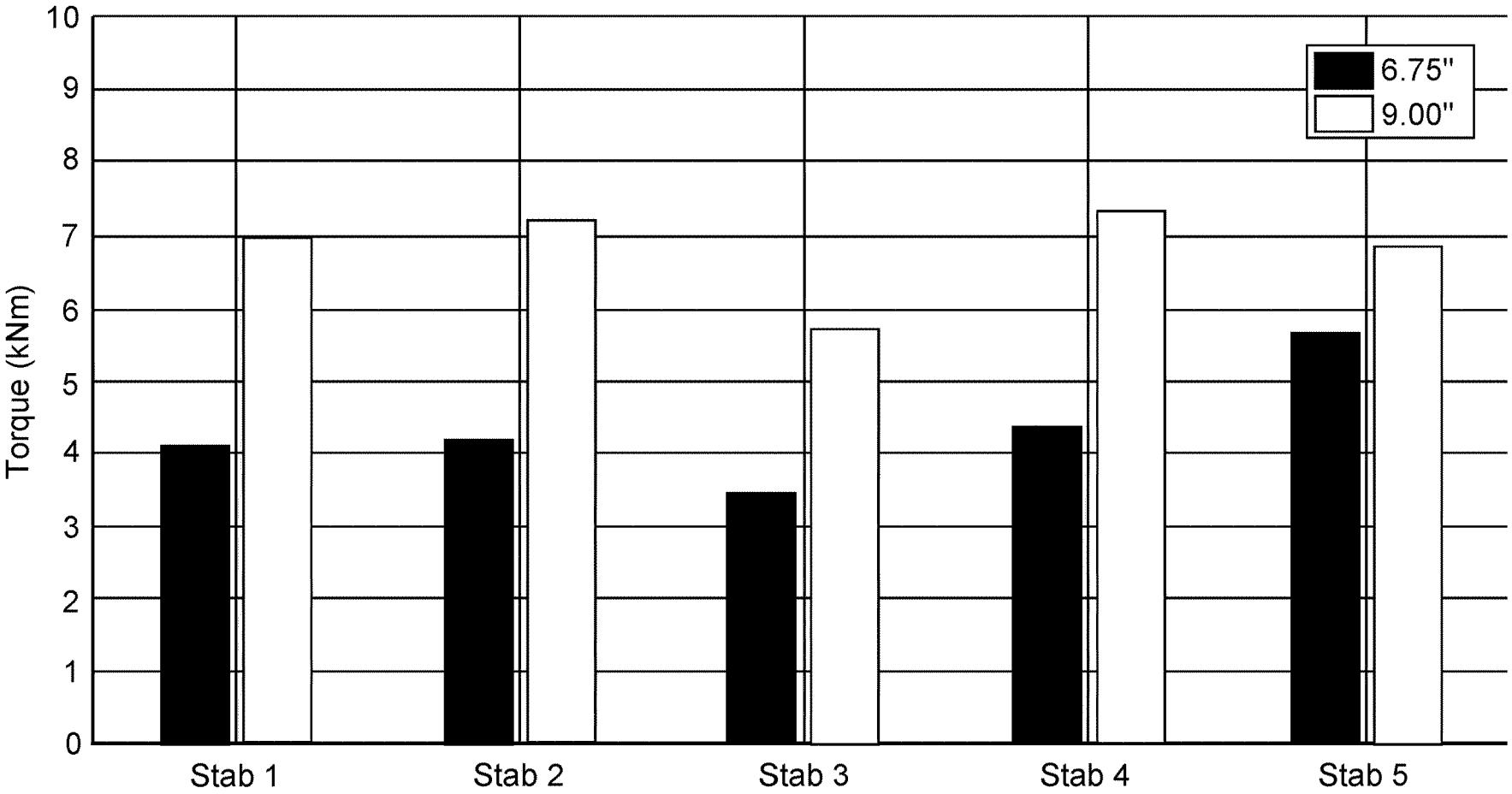
FIG. 9 includes plots of torque values under backward whirl for different stabilizers of different sizes, according to some embodiments of the present disclosure.

FIGS. 8 and 9 illustrate aspects of the numerical models applied to the tests. In FIG. 8, estimations for torque values in normal drilling are shown for various 6.75 in. (17.1 cm) BHAs, with different degrees of inclination in the wellbore. FIG. 9 includes plots of anticipated torque values under backward whirl with an inclination of 5 to 15 degrees, at 150 rpm, and with a friction value of 0.3. According to these particular calculations, the typical torque values expected to occur under drilling conditions for different stabilizer designs should generally not exceed 1.5 kNm, which was the maximum torque calculated in the considered cases, which included both the shown 6.75 in. (17.1 cm) BHAs and other 9.00 in. (22.9 cm) BHAs. During backward whirl on the other hand, there it can be seen that torque generated was within the range of 3.5 to 7.5 kNm on the stabilizers, depending on the size, stabilizer position, drilling inclination, and BHA type. These figures can be used as guidelines while designing the coupling mechanism of the stabilizer to the rest of the assembly, which is meant to stay intact (e.g., locked relative rotation) during normal operations, but to allow slipping when in backward whirl.

Of course, in other embodiments or conditions, the torque value for a design may be varied. For instance, rather than setting a threshold at 1.5 kNm, other designs or conditions may use a different value. For instance, a threshold value may be any value between 0.5 kNm and 10 kNm in other embodiments.

The embodiments of described herein have been primarily been described with reference to downhole operations and downhole drilling operations; however, tools described herein may be used in applications other than the drilling of a wellbore. In other embodiments, tools of the present disclosure may be used outside a wellbore or other downhole environment used for the exploration or production of natural resources. For instance, tools of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment. Additionally, embodiments may be used for other industries where whirl occurs. For instance, general machining or manufacturing may include drive shafts or other rotating elements. Stabilization tools may be expanded to such operations to also mitigate whirl. In some such environments, rotation may occur in the absence of or with a reduced quantity of a fluid such as drilling fluid. In that case, the design of the stabilizer or other tool may vary from those described herein, as limited cuttings transport or fluid volumes may be taken into account. Other considerations such as contact area may be considered, but a collar may or may not include any ribs or similar features.

One or more specific embodiments of the present disclosure are described herein. These described embodiments are examples of the presently disclosed techniques. Additionally, in an effort to provide a concise description of these embodiments, not all features of an actual embodiment may be described in the specification.

Additionally, it should be understood that references to "one embodiment" or "an embodiment" in the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A stabilizer, comprising:

an outer collar;

an inner sleeve at least partially within the outer collar; and a locking mechanism including a first configuration in which the outer collar is rotationally fixed to the inner sleeve and a second configuration in which the outer collar is rotationally isolated relative to the inner sleeve, wherein the locking mechanism includes an actuator coupled to a controller.

2. The stabilizer of claim 1, the locking mechanism including a magnetic clutch.

3. The stabilizer of claim 2, the magnetic clutch including a plurality of magnets configured to provide magnetic forces between the outer collar and the inner sleeve.

4. The stabilizer of claim 3, a first magnet of the plurality of magnets being on the outer collar, and a second magnet of the plurality of magnets being on the inner sleeve.

5. The stabilizer of claim 4, the first magnet being aligned with the second magnet when the locking mechanism is in the first configuration, and out of alignment with the second magnet when the locking mechanism is in the second configuration.

6. The stabilizer of claim 3, the plurality of magnets including at least two magnets on the outer collar, the at least two magnets being in a same radial plane.

7. The stabilizer of claim 3, the plurality of magnets including at least two magnets on the outer collar, the at least two magnets being axially spaced along a length of the outer collar.

8. The stabilizer of claim 1, the locking mechanism including a sensor coupled to the controller and configured to sense at least one of vibrational, torque, or frictional forces on the outer collar, wherein the controller is configured to cause the actuator to selectively move the locking mechanism between the first and second configurations based on data obtained by the sensor.

9. The stabilizer of claim 8, the sensor configured to sense the at least one of vibrational, torque, or frictional forces on an outer surface of the outer collar.

10. The stabilizer of claim 8, the controller configured to switch the locking mechanism between the first configuration and second configuration in response to the sensor sensing friction or torque above a threshold.

11. The stabilizer of claim 10, the threshold being between 0.5 N and kNm and 10 kNm.

12. The stabilizer of claim 11, the threshold being at least 1.5 kNm.

13. The stabilizer of claim 1, the locking mechanism configured to switch between the first configuration and the second configuration using passively detected friction or torque.

14. A bottomhole assembly, comprising:

a downhole tool; and a stabilizer coupled at least indirectly to the downhole tool, the stabilizer including:

an outer collar;

an inner sleeve at least partially within the outer collar; and a locking mechanism configured to rotationally fix the outer collar to the inner sleeve in a first configuration and to rotationally isolate the outer collar relative to the inner sleeve in a second configuration, wherein the locking mechanism includes an actuator coupled to a controller.

15. The bottomhole assembly of claim 14, wherein the downhole tool is a drill bit.

16. The bottomhole assembly of claim 14, wherein the downhole tool is a downhole motor.

17. The bottomhole assembly of claim 16, wherein the stabilizer is positioned below the downhole motor.

18. The bottomhole assembly of claim 14, the inner sleeve including a drill string and the outer collar being coupled to the drill string.

19. A stabilizer, comprising:

an outer collar;

an inner sleeve at least partially within the outer collar; and a locking mechanism including a first configuration in which the outer collar is rotationally fixed to the inner sleeve and a second configuration in which the outer collar is rotationally isolated relative to the inner sleeve, wherein the locking mechanism is configured to switch between the first configuration and the second configuration using passively detected rotational friction or torque.

20. The stabilizer of claim 19, wherein the locking mechanism comprises a magnetic clutch having a plurality of magnets, the outer collar comprises a plurality of ribs, and at least one magnet of the plurality of magnets is disposed in each rib of the plurality of ribs.

21. The stabilizer of claim 19, wherein the outer collar comprises an annular body, a plurality of ribs extending radially from the annular body, and a compressible material disposed between the annular body and each rib of the plurality of ribs.

* * * * *